US010393408B2

(12) United States Patent
Okazaki

(10) Patent No.: US 10,393,408 B2
(45) Date of Patent: Aug. 27, 2019

(54) AIR CONDITIONER

(71) Applicant: Mitsubishi Electric Corporation, Tokyo (JP)

(72) Inventor: Takashi Okazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 296 days.

(21) Appl. No.: 15/305,152

(22) PCT Filed: Apr. 22, 2014

(86) PCT No.: PCT/JP2014/061285
§ 371 (c)(1),
(2) Date: Oct. 19, 2016

(87) PCT Pub. No.: WO2015/162689
PCT Pub. Date: Oct. 29, 2015

(65) Prior Publication Data

US 2017/0122630 A1 May 4, 2017

(51) Int. Cl.
*F25B 6/02* (2006.01)
*F25B 5/02* (2006.01)
(Continued)

(52) U.S. Cl.
CPC ..... *F25B 5/02* (2013.01); *F24F 1/18* (2013.01); *F24F 11/89* (2018.01); *F25B 13/00* (2013.01);
(Continued)

(58) Field of Classification Search
CPC ..... F25B 5/02; F25B 6/02; F25B 2400/23; F25B 39/028; F24F 2221/16; F24F 2013/202
See application file for complete search history.

(56) References Cited

U.S. PATENT DOCUMENTS

2005/0132744 A1 6/2005 Rohrer et al.
2009/0025409 A1* 1/2009 Kopko ..... F25B 39/04 62/186
(Continued)

FOREIGN PATENT DOCUMENTS

CN 203323459 U 12/2013
EP 2 378 215 A1 10/2011
(Continued)

OTHER PUBLICATIONS

Office Action dated Oct. 30, 2017 issued in corresponding KR patent application No. 10-2016-7032399. (with English translation).
(Continued)

*Primary Examiner* — David J Teitelbaum
(74) *Attorney, Agent, or Firm* — Posz Law Group, PLC

(57) ABSTRACT

The outdoor heat exchanger includes, on each of the three or more heat exchange sections, a liquid-side header pipe, a gas-side header pipe, and a plurality of heat exchange pipes, the three or more heat exchange sections are connected in parallel to one another, a plurality of the liquid-side header pipes are connected to a liquid-side collecting pipe through an intermediation of a branch section and at least one flow control section, each of the plurality of the liquid-side header pipes includes a perforated pipe, the refrigeration circuit further includes a bypass pipe for connecting a discharge side of the compressor and the liquid-side collecting pipe, and the bypass pipe includes an on-off valve to be closed during cooling and heating, and to be opened during defrosting.

7 Claims, 7 Drawing Sheets

(51) Int. Cl.

| | |
|---|---|
| ***F24F 11/89*** | (2018.01) |
| ***F24F 1/18*** | (2011.01) |
| ***F25B 13/00*** | (2006.01) |
| ***F25B 41/04*** | (2006.01) |
| ***F25B 40/00*** | (2006.01) |
| ***F25B 47/02*** | (2006.01) |
| *F24F 13/20* | (2006.01) |
| *F25B 39/02* | (2006.01) |

(52) U.S. Cl.
CPC ..... *F25B 40/00* (2013.01); *F25B 41/04* (2013.01); *F25B 47/022* (2013.01); *F24F 2013/202* (2013.01); *F24F 2221/16* (2013.01); *F25B 6/02* (2013.01); *F25B 39/028* (2013.01); *F25B 2400/121* (2013.01); *F25B 2400/23* (2013.01)

(56) References Cited

U.S. PATENT DOCUMENTS

2010/0282435 A1* 11/2010 Yabuuchi ..... F24D 17/0073 165/63
2011/0056668 A1* 3/2011 Taras ..... F28D 1/0478 165/174
2013/0186126 A1 7/2013 Morimoto et al.
2014/0060108 A1 3/2014 Roman
2014/0318173 A1* 10/2014 Koike ..... F24F 1/56 62/426
2015/0253040 A1* 9/2015 Aschan ..... F25B 40/00 62/498

FOREIGN PATENT DOCUMENTS

| | | | |
|---|---|---|---|
| EP | 2 693 134 | A1 | 2/2014 |
| JP | 63-198929 | U | 12/1988 |
| JP | 05-045007 | A | 2/1993 |
| JP | 2971223 | B | 6/1993 |
| JP | 2002-71208 | A | 3/2002 |
| JP | 2005-180910 | A | 7/2005 |
| JP | 2008-96095 | A | 4/2008 |
| JP | 2013-139971 | A | 7/2013 |
| KR | 20080022324 | A | 3/2008 |
| WO | 2012/066608 | A1 | 5/2012 |
| WO | 2013/161038 | A1 | 10/2013 |

OTHER PUBLICATIONS

Extended European Search Report dated Dec. 5, 2017 issued in corresponding EP patent application No. 14889898.4.
International Search Report of the International Searching Authority dated Aug. 5, 2014 for the corresponding International application No. PCT/JP2014/061285 (and English translation).
Office Action dated Jul. 3, 2018 issued in corresponding CN patent application No. 201480077991.1. (and English translation).

* cited by examiner

AIR CONDITIONER

CROSS REFERENCE TO RELATED APPLICATIONS

This application is a U.S. national stage application of PCT/JP2014/061285 filed on Apr. 22, 2014, the contents of which are incorporated herein by reference.

TECHNICAL FIELD

This invention relates to an air conditioner.

BACKGROUND ART

A parallel-flow type heat exchanger is available as a type of heat exchanger. This heat exchanger includes a pair of header pipes and a plurality of flat tubes provided between the header pipes, and is configured such that a fluid flowing into one of the headers passes through the plurality of flat tubes and flows out into the other header pipe.

In this parallel-flow type heat exchanger, when the pair of header pipes are disposed so as to be oriented in a vertical direction, liquid refrigerant in a gas-liquid two phase refrigerant is likely to flow into the flat tubes positioned therebelow due to the effects of gravity, making it difficult to control the refrigerant flowing through the plurality of flat tubes to a uniform flow rate. In a top-flow type heat exchanger in particular, such as a multi air conditioner for a building, an air flow increases steadily upward toward the blower, and since the flow rate of the refrigerant cannot be increased in a location with a high air flow, the heat exchanger cannot be utilized effectively.

Hence, to reduce the effects of gravity among the plurality of flat tubes, a parallel-flow type heat exchanger may be configured such that the pair of header pipes are disposed horizontally.

Meanwhile, an existing outdoor unit of an air conditioner may be configured such that heat exchange sections are disposed on a plurality of surfaces of a casing of the outdoor unit. Here, when an attempt is made to cause a parallel-flow type heat exchanger in which the pair of header pipes are disposed horizontally, as described above, to function on a plurality of surfaces of the casing of the outdoor unit, the header pipes must be bent in alignment with the plurality of surfaces. However, bending a header pipe into an L shape or an angled C shape, for example, requires a large load, leading to increases in device size and cost.

A heat exchanger disclosed in PTL 1, for example, is available in relation to this problem. In the heat exchanger disclosed in PTL 1, the heat exchanger is divided into a plurality of blocks, and the plurality of divided blocks are disposed in a horizontal direction.

CITATION LIST

Patent Literature

[PTL 1] Japanese Patent Application Publication No. 2002-71208

SUMMARY OF INVENTION

Technical Problem

In the heat exchanger disclosed in PTL 1, however, it is assumed that the refrigerant is distributed evenly by a branch section, but when a thermal load distribution exists in the horizontal direction, or in other words when a temperature distribution or an air velocity distribution exists, the refrigerant is not distributed evenly among the blocks, and as a result, a desired heat exchange performance cannot be obtained. Further, due to the effects of a thermal load distribution within a single block and a flow condition of a gas-liquid two phase flow, the refrigerant cannot be distributed favorably among the plurality of flat tubes within the block, and as a result, a desired heat exchange performance cannot be obtained. Moreover, a refrigerant flow direction during defrosting is not taken into consideration, and therefore ice caused by frost formation in a lower section of the heat exchanger is not completely melted during a defrosting operation, leading to growth of ice that has not completely melted.

This invention has been designed in consideration of the circumstances described above, and an object thereof is to provide an air conditioner in which a refrigerant can be distributed evenly through a top-flow type outdoor unit in which an air velocity difference occurs in a height direction, even when the top-flow type outdoor unit includes a plurality of heat exchange sections.

Solution to Problem

To achieve the object described above, an air conditioner according to this invention includes a refrigeration circuit, the refrigeration circuit including a compressor, an outdoor heat exchanger, a decompression valve, and an indoor heat exchanger, and a top-flow type outdoor unit, wherein the outdoor heat exchanger is provided in the top-flow type outdoor unit, the outdoor heat exchanger has three or more heat exchange sections, the outdoor heat exchanger includes, on each of the three or more heat exchange sections, a liquid-side header pipe, a gas-side header pipe, and a plurality of heat exchange pipes provided between the liquid-side header pipe and the gas-side header pipe, the three or more heat exchange sections are connected in parallel to one another, a plurality of the liquid-side header pipes are connected to a liquid-side collecting pipe through an intermediation of a branch section and at least one flow control section, each of the plurality of the liquid-side header pipes includes a perforated pipe provided thereinside, the refrigeration circuit further includes a bypass pipe for connecting a discharge side of the compressor and the liquid-side collecting pipe, and the bypass pipe includes an on-off valve to be closed during cooling and heating, and to be opened during defrosting.

Advantageous Effects of Invention

According to this invention, a refrigerant can be distributed evenly through a top-flow type outdoor unit in which an air velocity difference occurs in a height direction, even when the top-flow type outdoor unit includes a plurality of heat exchange sections.

DESCRIPTION OF EMBODIMENTS

Figure 1:
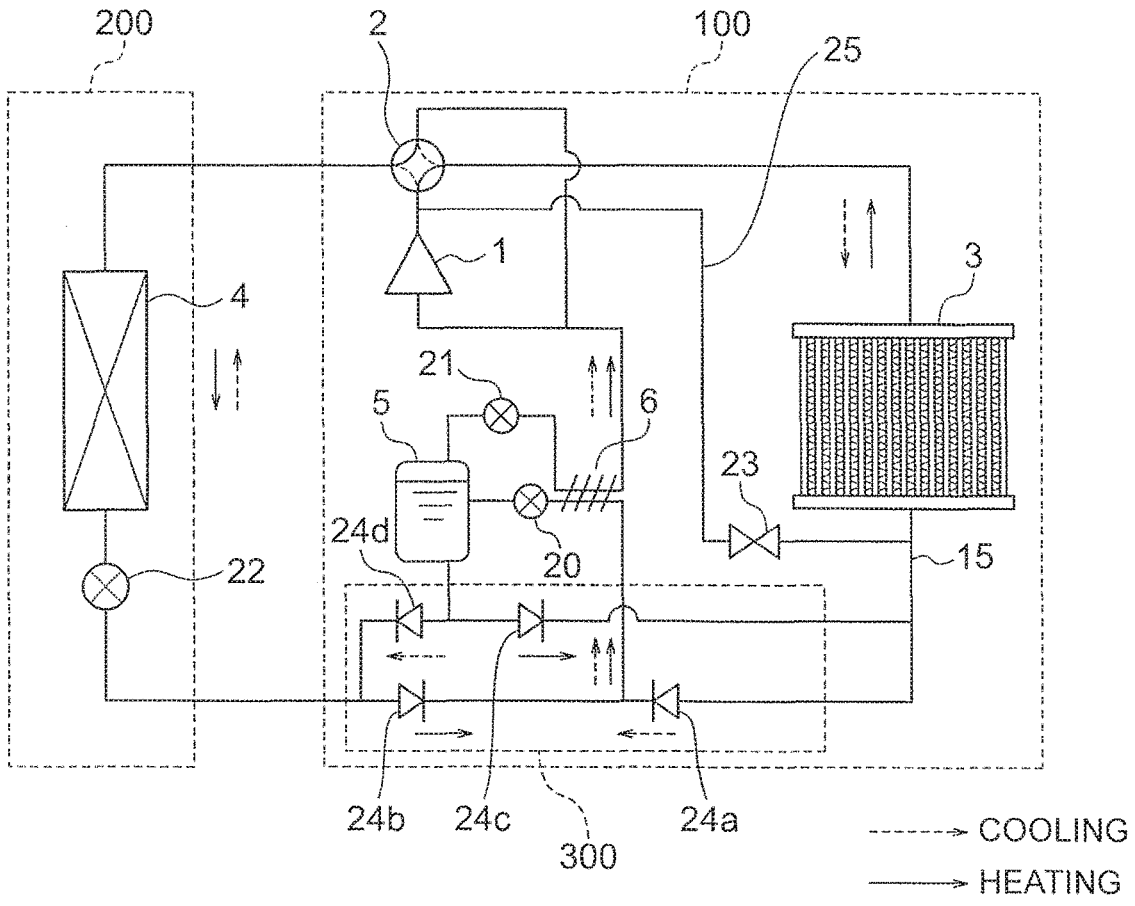
FIG. 1 is a view showing a configuration of a refrigeration circuit pertaining to a first embodiment of this invention.

Embodiments of this invention will be described below on the basis of the attached drawings. Note that in the drawings, identical reference numerals are assumed to denote identical or corresponding parts.

First Embodiment

FIG. 1 is a view showing a configuration of a refrigeration circuit pertaining to a first embodiment of this invention. A refrigeration circuit of an air conditioner according to the first embodiment functions as an air conditioner installed in a subject space in order to cool and heat the subject space. Hence, during cooling, a refrigerant flows as indicated by dotted line arrows in FIG. 1, and during heating, the refrigerant flows as indicated by solid line arrows.

The refrigeration circuit includes an outdoor unit 100 and an indoor unit 200. The outdoor unit 100 is provided with a compressor 1, a four-way valve 2, an outdoor heat exchanger 3, a gas-liquid separator 5, an internal heat exchanger 6, a first decompression valve 20, a second decompression valve 21, an on-off valve 23, and a check valve unit 300.

The second decompression valve 21 is provided in a pipe that connects a gas side of the gas-liquid separator 5 to an intake section of the compressor 1. The on-off valve 23 is provided in a pipe that connects an outlet of the compressor 1 to a liquid side of the outdoor heat exchanger 3.

The check valve unit 300 is constituted by check valves 24*a* to 24*d*. As long as the check valve unit 300 has a function for rectifying the refrigerant flow, the configuration thereof is not limited to a plurality of check valves, and the check valve unit 300 may be constituted by other means such as a four-way valve or a plurality of solenoid valves.

The indoor unit 200 is constituted by an indoor heat exchanger 4 and a third decompression valve 22.

Next, an operation of the refrigeration circuit will be described. During a cooling operation, the interior of the four-way valve 2 is connected as indicated by solid lines such that the refrigerant flows through the refrigeration circuit as indicated by the dotted line arrows. Further, the first decompression valve 20, the second decompression valve 21, and the third decompression valve 22 are respectively set at appropriate openings, while the on-off valve 23 is fully closed.

The opening of the third decompression valve 22 is larger than the opening of the first decompression valve 20 such that decompression is realized mainly by the first decompression means 20. At this time, high-temperature, high-pressure refrigerant gas discharged from the compressor 1 is condensed by the outdoor heat exchanger 3 (a condenser), passes through the check valve 24*a* so as to be cooled by the internal heat exchanger 6, is decompressed to a certain extent in the first decompression valve 20, and then enters the gas-liquid separator 5.

Gas refrigerant separated by the gas-liquid separator 5 returns to the intake section of the compressor 1 via the second decompression valve 21, while liquid refrigerant from the gas-liquid separator 5 passes through the check valve 24*d* and the third decompression valve 22 so as to enter the indoor heat exchanger 4.

Refrigerant evaporated by the indoor heat exchanger (an evaporator) 4 cools the air in a room, not shown in the drawing, and then self-evaporates so as to return to the intake section of the compressor 1 through the four-way valve 2.

By providing the internal heat exchanger 6 in the first embodiment, with the efficiency of the gas-liquid separator 5 being reduced, the refrigerant even in the form of a two-phase refrigerant passing through the second decompression valve 21 can be evaporated by the internal heat exchanger 6 and returned to the intake section of the compressor 1. As a result, reductions in performance and reliability occurring when liquid returns to the compressor 1 can be suppressed. Further, the refrigerant gas is bypassed using the gas-liquid separator 5, and therefore pressure loss in the indoor heat exchanger 4 can be reduced, leading to an increase in intake pressure in the compressor 1 and a corresponding improvement in performance.

During a heating operation, meanwhile, the interior of the four-way valve 2 is connected as indicated by dotted lines such that the refrigerant flows through the refrigeration circuit as indicated by the solid line arrows. Further, the first decompression valve 20, the second decompression valve 21, and the third decompression valve 22 are respectively set at appropriate openings, while the on-off valve 23 is fully closed.

The opening of the third decompression valve 22 is larger than the opening of the first decompression valve 20 such that decompression is realized mainly by the first decompression valve 20. In other words, the high-temperature, high-pressure refrigerant gas discharged from the compressor 1 is condensed by the indoor heat exchanger (a condenser) 4, passes through the check valve 24*b* so as to be cooled by the internal heat exchanger 6, is decompressed to a certain extent in the first decompression valve 20, and then enters the gas-liquid separator 5.

The gas refrigerant separated by the gas-liquid separator 5 returns to the intake section of the compressor 1 via the second decompression valve 21, while the liquid refrigerant passes through the check valve 24*c* so as to enter the outdoor heat exchanger (an evaporator) 3. Refrigerant evaporated by the outdoor heat exchanger 3 returns to the intake section of the compressor 1 through the four-way valve 2.

A defrosting operation performed when frost forms in the outdoor heat exchanger 3 due to continuous implementation of the heating operation in high-humidity outside air conditions will now be described. The refrigeration circuit is provided with a bypass pipe 25 that connects the discharge side of the compressor 1 to a lower section of the outdoor heat exchanger 3 (in other words, connects the discharge side of the compressor 1 to a liquid-side collecting pipe 15, to be described below, of the outdoor heat exchanger 3). During the defrosting operation, the on-off valve 23, which is provided in the bypass pipe 25, is opened so that high-temperature discharged gas is supplied directly to the liquid pipe side of the outdoor heat exchanger 3. Note that during cooling and heating, the on-off valve 23 is closed. In other words, the refrigerant discharged from the compressor 1 is supplied from the liquid pipe side to the outdoor heat exchanger 3 through the on-off valve 23. The refrigerant, having been condensed by the outdoor heat exchanger 3, melts ice caused by frost formed on fins, not shown in the drawing, and is then taken into the compressor 1 through the four-way valve 2. In this embodiment, the discharged gas is supplied from the lower section of the outdoor heat exchanger 3, where a large amount of frost is formed, and therefore the frost can be melted efficiently. Moreover, a phenomenon whereby ice in the lower section of the outdoor heat exchanger 3 is not completely melted and continues to grow can be avoided.

Figure 2:
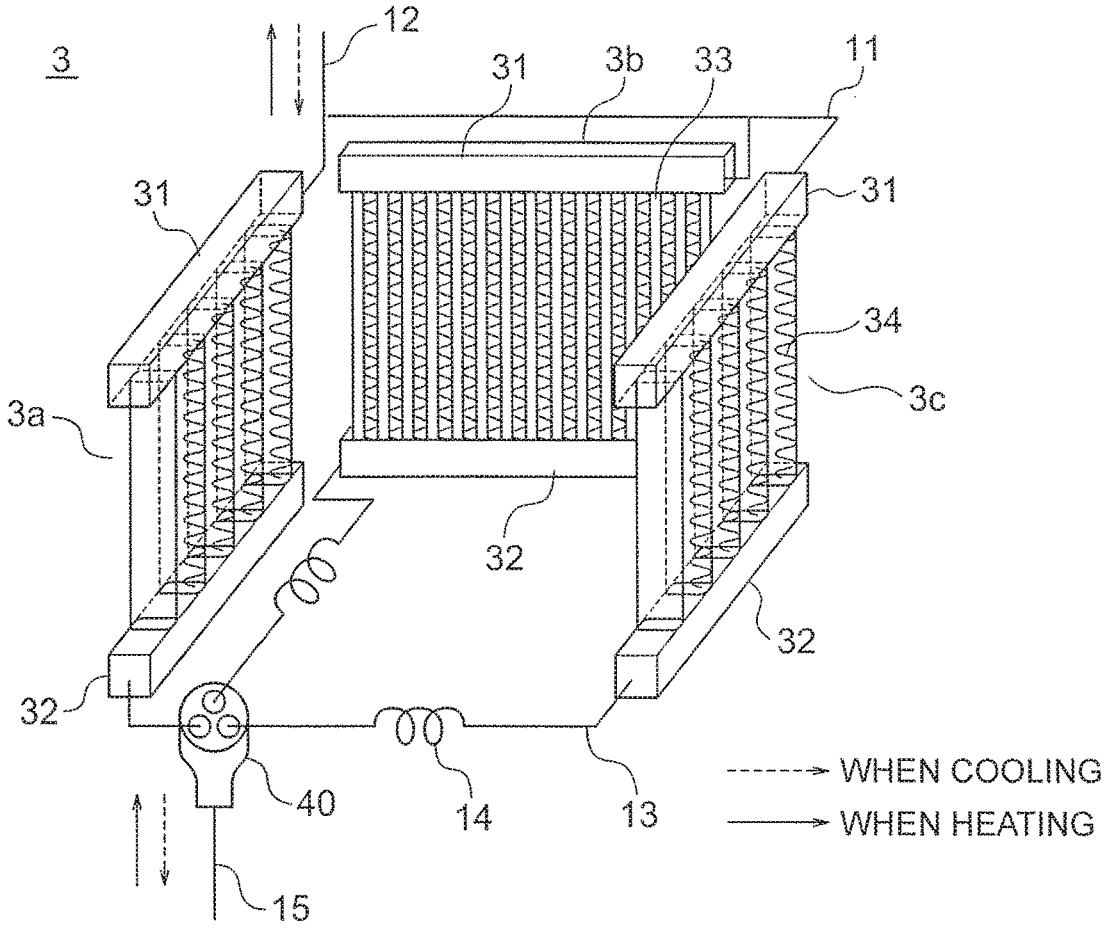
FIG. 2 is a view pertaining to the first embodiment, and showing a connection configuration between a flow divider and a heat exchanger.

FIG. 2 is a view showing in detail the configuration of the outdoor heat exchanger 3 of the refrigeration circuit shown in FIG. 1. The outdoor heat exchanger 3 has a parallel-flow type configuration such that when the outdoor heat exchanger 3 operates as a condenser during cooling, the refrigerant forms a parallel flow that flows through the outdoor heat exchanger 3 from top to bottom, as indicated by dotted line arrows, and when the outdoor heat exchanger 3 operates as an evaporator during heating, the refrigerant forms a parallel flow that flows through the outdoor heat exchanger 3 from bottom to top, as indicated by solid line arrows. Further, the outdoor heat exchanger 3 includes a plurality of heat exchange sections 3*a*, 3*b*, 3*c*, FIG. 2 showing an example of a case in which three heat exchange sections are provided. Note that the heat exchange sections are not merely surfaces of flat tubes, and are not two-dimensional planes having no thickness. Each heat exchange section is an imaginary planar unit that extends in an arrangement direction of a plurality of flat tubes, and has a front and a rear serving respectively as an inflow side and an outflow side for air that is subjected to heat exchange.

A gas-side header pipe 31, a liquid-side header pipe 32, and a plurality of heat exchange pipes 33 provided between the upper-lower pair of header pipes 31, 32 are provided in each heat exchange section 3*a*, 3*b*, 3*c*. Specifically, flat tubes are used as the heat exchange pipes 33. Fins 34 (more specifically, corrugated fins) are provided between the heat exchange pipes 33.

One end of a corresponding gas-side connecting pipe 11 is connected to each of the gas-side header pipes 31. The other end side of each of the plurality of gas-side connecting pipes 11 is connected to a gas-side collecting pipe 12. One end of a corresponding liquid-side connecting pipe 13 is connected to each of the liquid-side header pipes 32. A flow control section 14 is provided in at least one of the plurality of liquid-side connecting pipes 13. The other end side of each of the plurality of liquid-side connecting pipes 13 is connected to a liquid-side collecting pipe 15 via a branch section 40, to be described below.

Hence, the plurality of heat exchange sections are disposed so as to be connected to one another in parallel between the gas-side collecting pipe 12 and the liquid-side collecting pipe 15. Although not shown in the drawings, it is assumed that blocking members such as metal plates are provided to cover adjacent pairs of heat exchange sections 3 so that the liquid to be subjected to heat exchange does not bypass the heat exchange sections 3.

The branch section 40 is used to supply refrigerant having an equal degree of dryness to the plurality of liquid-side header pipes 32. In the example configuration to be described in this embodiment, when the refrigerant flows through the outdoor heat exchanger 3 from bottom to top during heating, gas-liquid two phase refrigerant is supplied to the three heat exchange sections at an equal degree of dryness, and the flow rate at which the refrigerant flows to each heat exchange section is controlled by the flow control section 14.

A distributor may be cited as an example of the branch section 40 with which an equal degree of dryness is obtained. A distributor is a flow divider in which inflowing gas-liquid two phase refrigerant is formed into a mist flow in an orifice (a narrow flow passage) and then distributed to a plurality of flow passages. One end side of the branch section 40 is connected to the liquid-side collecting pipe 15, and each of a plurality of connection ports at the other end side is connected to one end of the corresponding liquid-side connecting pipe 13.

The flow control section 14 has a flow control function, and in the example shown in the drawings, employs a capillary tube. The flow control section 14 is provided between the branch section 40 and the corresponding liquid-side header pipe 32, or in other words in each liquid-side connecting pipe 13, but does not necessarily have to be provided in all of the liquid-side connecting pipes 13. In the example configuration shown in FIG. 2, two flow control sections 14 are provided, the flow control sections 14 being provided in two of the three liquid-side connecting pipes 13.

Further, the other end of each liquid-side connecting pipe 13 is connected to the corresponding liquid-side header pipe 32. The branch section 40 and the at least one flow control section 14 connected in this manner control the flow rate at which the refrigerant flows to each heat exchange section in accordance with a thermal load of each heat exchange section such that the refrigerant is supplied to the plurality of liquid-side connecting pipes 32 at an equal degree of dryness.

In each heat exchange section, a connection port between the liquid-side header pipe 32 and the liquid-side connecting pipe 13 and a connection port between the gas-side header pipe 31 and the gas-side connecting pipe 11 are positioned in opposite directions in a lengthwise direction of the header pipes. In other words, the connection port connecting the liquid-side header pipe 32 to the liquid-side connecting pipe 13 is provided on one end side of the liquid-side header pipe 32, and the connection port connecting the gas-side header pipe 31 to the gas-side connecting pipe 11 is provided on the other end side of the gas-side header pipe 32. Hence, a refrigerant inlet and a refrigerant outlet to and from the heat exchange section are disposed on opposite sides both vertically and horizontally (opposite sides in the lengthwise direction of the header pipes) such that all of the heat exchange pipes 33 of each heat exchange section have substantially equal refrigerant flow passage lengths.

Figure 3:
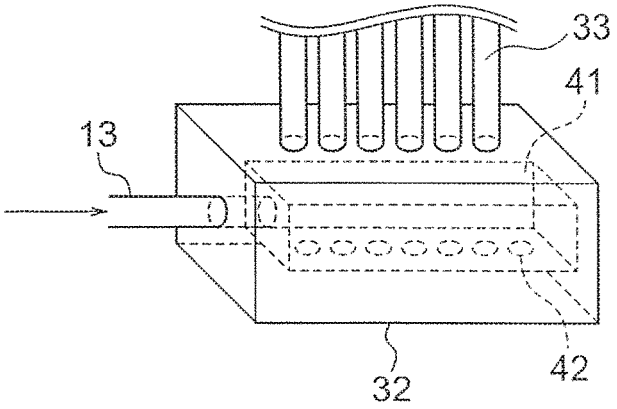
FIG. 3 is a perspective view showing a liquid-side header pipe in order to illustrate a perforated pipe.

FIG. 3 is a perspective view showing the liquid-side header pipe 32 in order to illustrate a perforated pipe. Respective lower ends of the corresponding plurality of heat exchange pipes 33 are connected to an upper section of the liquid-side header pipe 32. As shown in FIG. 3, a perforated pipe 41 is provided inside each liquid-side header pipe 32.

The perforated pipe 41 is a block-shaped or pipe-shaped member provided substantially centrally in a space inside the liquid-side header pipe 32 so as not to contact an inner surface of the liquid-side header pipe 32. In other words, a first space is formed inside the perforated pipe 41, and a second space is formed between an outer side of the perforated pipe 41 and an inner side of the liquid-side header pipe 32.

A large number of distribution holes 42 are provided in the perforated pipe 41. In this example, the distribution holes 42 are formed substantially in a lower side of the perforated pipe 41. Hence, when refrigerant gas inside the perforated pipe 41 is ejected through the distribution holes 42, the refrigerant gas is blown into liquid refrigerant that has already accumulated below the perforated pipe 41, thereby promoting gas-liquid mixing.

By housing the perforated pipe 41 in the interior of the liquid-side header pipe 32, the liquid-side header pipe 32 is provided with a double pipe structure. Therefore, refrigerant flowing through the liquid-side connecting pipe 13 during heating, for example, flows into the perforated pipe 41, then flows out of the perforated pipe 41 through the large number of distribution holes 42 evenly in a depth direction (a left-right direction on the paper surface of FIG. 3), and is then dispersed evenly through the liquid-side header pipe 32 so as to be supplied evenly to the plurality of heat exchange pipes 33 through upper surface holes in the liquid-side header pipe 32.

Effects of the perforated pipe will now be described. By inserting the perforated pipe into the liquid-side header pipe such that the distribution holes formed therein are oriented downward, an action whereby a liquid film of the refrigerant in an annular region surrounded by the inner surface of the liquid-side header pipe and the outer surface of the perforated pipe is agitated by air bubbles shooting up from the bottom of the perforated pipe is obtained as desired regardless of the inlet dryness and the flow rate, and as a result, the refrigerant is distributed evenly.

Furthermore, in this embodiment, the refrigerant gas is bypassed using the gas-liquid separator, and therefore pressure loss in the evaporator can be reduced, leading to an increase in the intake pressure of the compressor and a corresponding improvement in performance during the cooling cycle. In addition, by providing the indoor heat exchanger, with the efficiency of the gas-liquid separator being reduced, the refrigerant even in the form of a two-phase refrigerant passing through the second decompression valve can be evaporated by the indoor heat exchanger and returned to the intake section of the compressor. As a result, reductions in performance and reliability occurring when liquid returns to the compressor can be suppressed.

Figure 4:
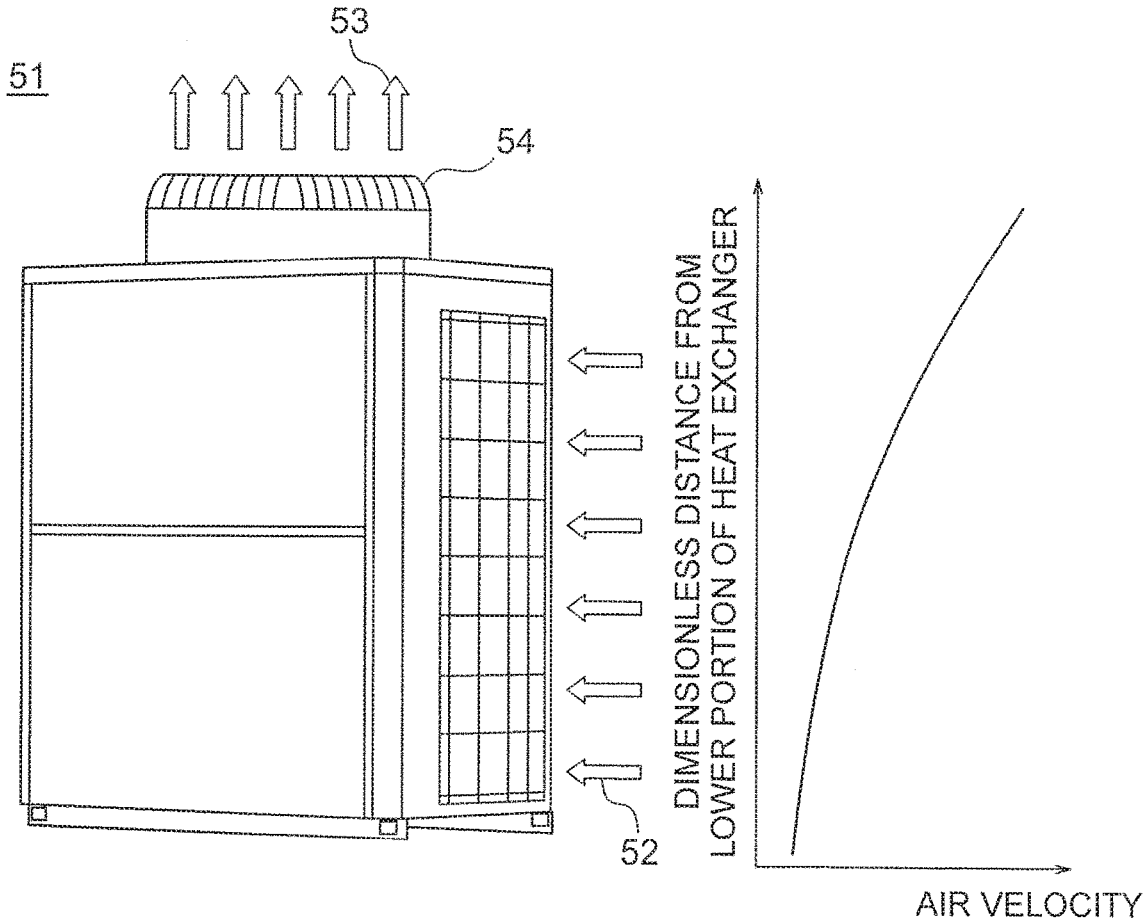
FIG. 4 is a view showing an outer appearance of an outdoor unit of a multi air conditioner for a building according to the first embodiment.
Figure 5:
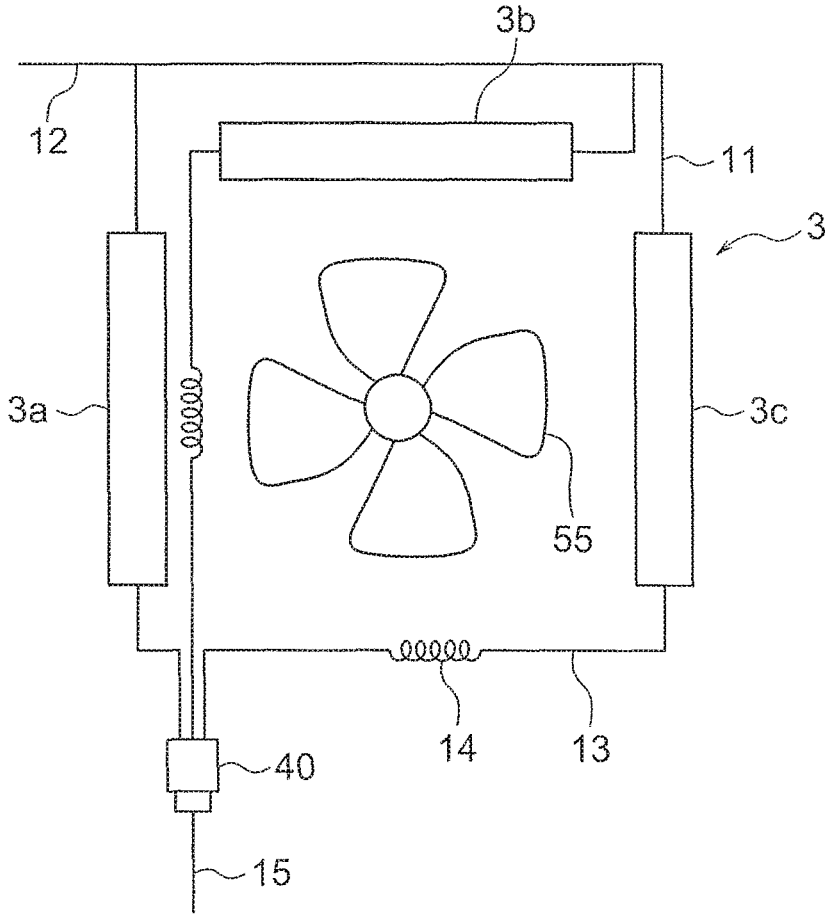
FIG. 5 is a view showing a connection configuration between a flow divider and a heat exchanger in the outdoor unit of the multi air conditioner for a building according to the first embodiment.

Next, a top-flow type outdoor unit provided in the air conditioner according to the first embodiment will be described. FIG. 4 is a view showing an outer appearance of an outdoor unit of a multi air conditioner for a building according to the first embodiment. FIG. 5 is a view showing a connection configuration between a flow divider and a heat exchanger in the outdoor unit of the multi air conditioner for a building according to the first embodiment. A top-flow type outdoor unit 51 is a top-flow (upward blowout) type outdoor unit of a (VRF: Variable Refrigerant Flow) multi air conditioner for a building.

In FIG. 4, arrows outlined in black denote a flow of air. Intake air 52 is taken into a casing of the top-flow type outdoor unit 51 from three side faces of the casing and subjected to heat exchange in respective heat exchange sections to be described below, whereupon blowout air 53 is blown out through a blowout port formed in a fan guard 54 provided on an upper surface of the casing.

As shown in FIG. 5, the heat exchange sections 3*a*, 3*b*, 3*c* are allocated respectively to three surfaces of the casing of the top-flow type outdoor unit 51, and a propeller fan 55 is disposed centrally in each heat exchange section when seen from above.

Next, an action of the top-flow type outdoor unit 51 according to the first embodiment, having the above configuration, will be described. During a heating operation, the outdoor unit heat exchanger 3 of the top-flow type outdoor unit 51 operates as an evaporator, and the refrigerant divided into three flows by the branch section 40 flows into the liquid-side header pipe 32 of the corresponding heat exchange section after the flow rate thereof in the corresponding flow passage has been controlled by the flow control section 14. The reason for controlling the flow rate of the refrigerant flowing to each heat exchange section in this manner is to regulate differences in thermal load distribution, or in other words temperature distribution and air velocity distribution, among the respective heat exchange sections by means of the flow rate of the refrigerant so that the refrigerant is discharged from the respective heat exchange sections in a uniform condition.

The refrigerant flowing in through one end of the liquid-side header pipe 32 is then ejected through the distribution holes 42 in the perforated pipe 41 so as to be distributed evenly to the respective heat exchange pipes 33. When the degree of dryness in the perforated pipe 41 is large, minute liquid droplets are ejected through the small holes, and when the degree of dryness is small, air bubbles shoot up into the liquid that has accumulated in the annular section. As a result, an even distribution is realized regardless of the degree of dryness and the flow rate. The refrigerant exchanges heat with air, not shown in the drawings, while passing through the heat exchange pipes 33, then flows into the gas-side header pipe 31, flows out of the other end on the opposite side to the liquid-side header pipe 32, passes through the gas-side connecting pipe 11, and converges with the refrigerant from an adjacent heat exchange section in the gas-side collecting pipe 12.

During a cooling operation, the outdoor heat exchanger 3 operates as a condenser, and the refrigerant flows in an opposite direction.

In an outdoor unit of a multi air conditioner for a building, as shown in FIG. 4, a relationship exists between a height position from the bottom of the casing and the air velocity. Here, when a plate fin type heat exchanger is used in the top-flow type outdoor unit, a complicated structure in which a number of disposed heat transfer tubes is reduced in order to reduce a heat transfer area so that a uniform heat exchange performance is obtained in the height direction is conventionally employed in a part where the air velocity is high. In the first embodiment, on the other hand, the direction in which an air velocity difference occurs (i.e. the height direction) matches the refrigerant flow direction, and therefore complicated design work relating to a number of branches and a branch pattern is not required.

With the first embodiment, as described above, following advantages are obtained. Three heat exchange sections are provided in accordance with the three intake side faces of the top-flow type outdoor unit, and connected to one another in parallel. Further, the liquid-side header pipes are connected to the liquid-side collecting pipe via the branch section and the flow control section. Hence, the rate at which the refrigerant flows through each of the three heat exchange sections can be controlled by the flow control section even when a thermal load distribution, or in other words a temperature distribution and an air velocity distribution, exists in the horizontal direction, and therefore the refrigerant can be distributed evenly, with the result that a desired heat exchange performance can be obtained. Further, although a problem remains in that the refrigerant is distributed unevenly over the plurality of flat tubes connected to a common header pipe, the magnitude of the unevenness occurring in a single heat exchange section is reduced in the first embodiment by increasing the number of heat exchange sections, and by additionally controlling the flow rate of the refrigerant among the heat exchange sections, a desired heat exchange performance can be obtained.

In this embodiment, the refrigerant is distributed to the heat exchange sections after the dryness of the refrigerant and the flow rate of the refrigerant have been controlled to desired levels in accordance with the conditions of the respective heat exchange sections via the distributor and the flow control section, and therefore an extremely favorable heat exchange performance can be obtained in all of the heat exchange sections. Moreover, a flow passage for collecting the refrigerant that has undergone heat exchange in the plurality of heat exchange pipes and redistributing the refrigerant to the plurality of heat exchange pipes through an inter-row connection section is not provided in the flow direction of the heat exchanger, and therefore a situation in which the refrigerant can no longer be supplied evenly to the plurality of heat exchange pipes does not arise.

Furthermore, in each heat exchange section, the inlet and outlet to and from the liquid-side header pipe are disposed on opposite sides to the inlet and outlet to and from the gas-side header pipe, and therefore pressure loss in the refrigerant can be made substantially equal in all of the heat exchange pipes. In other words, an evenly distributed gas-liquid two phase flow can be realized. Moreover, by providing the perforated pipe in the liquid-side header pipe, minute liquid droplets and air bubbles are ejected through the distribution holes into the annular section of the double structure, thereby promoting even distribution of the gas-liquid two phase refrigerant. Further, in this embodiment, the number of heat exchange pipes to which the refrigerant is distributed is increased and the number of times the refrigerant is distributed to the heat exchange pipes is reduced (in the example described above, the refrigerant is distributed to the heat exchange pipes only once), and therefore, even though a large number of heat exchange pipes is used, pressure loss in the refrigerant can be suppressed to a low level in proportion to the number of heat exchange pipes. As a result, this embodiment can be used particularly effectively with a refrigerant exhibiting large refrigerant pressure loss, for example HFO1234yf, HFO1234ze, a mixture thereof, or R134a.

Furthermore, the bypass pipe is provided to connect the discharge side of the compressor to the liquid-side collecting pipe of the outdoor heat exchanger, and therefore the discharged gas can be supplied to the plurality of heat exchange sections at once from the lower section of the outdoor heat exchanger, where a large amount of frost forms. As a result, the frost can be melted efficiently. Moreover, a phenomenon whereby ice in the lower section of the outdoor heat exchanger is not completely melted and continues to grow can be avoided.

Hence, according to the first embodiment, in a top-flow type outdoor unit in which an air velocity difference occurs in the height direction, refrigerant can be distributed evenly through a plurality of heat exchange sections without the need for complicated design work relating to a number of branches and a branch pattern. Furthermore, the plurality of heat exchange sections can be defrosted efficiently.

Second Embodiment

Figure 6:
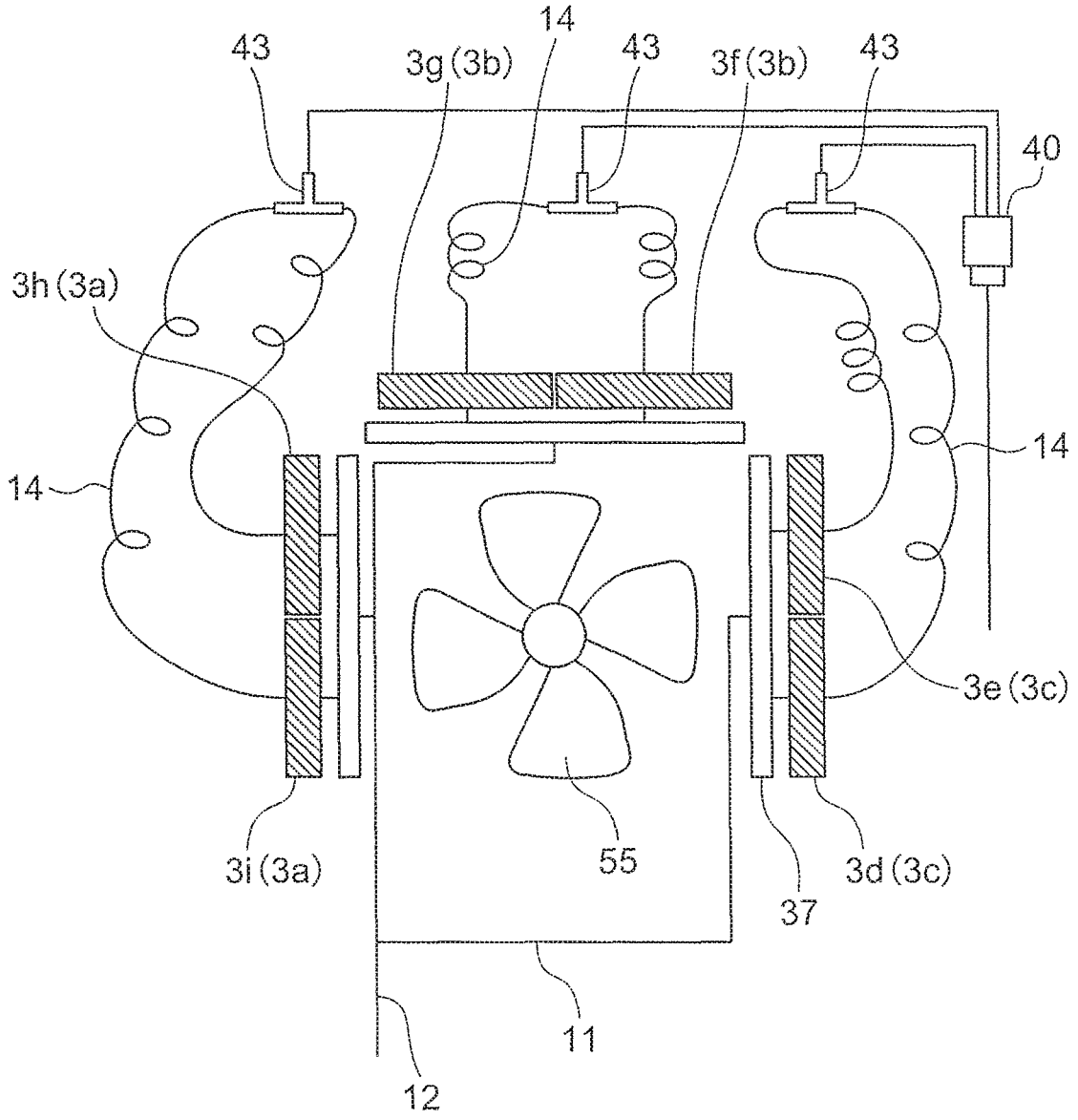
FIG. 6 is a view showing a connection configuration between a flow divider and a heat exchanger of an outdoor unit of a multi air conditioner for a building according to a second embodiment of this invention.
Figure 7:
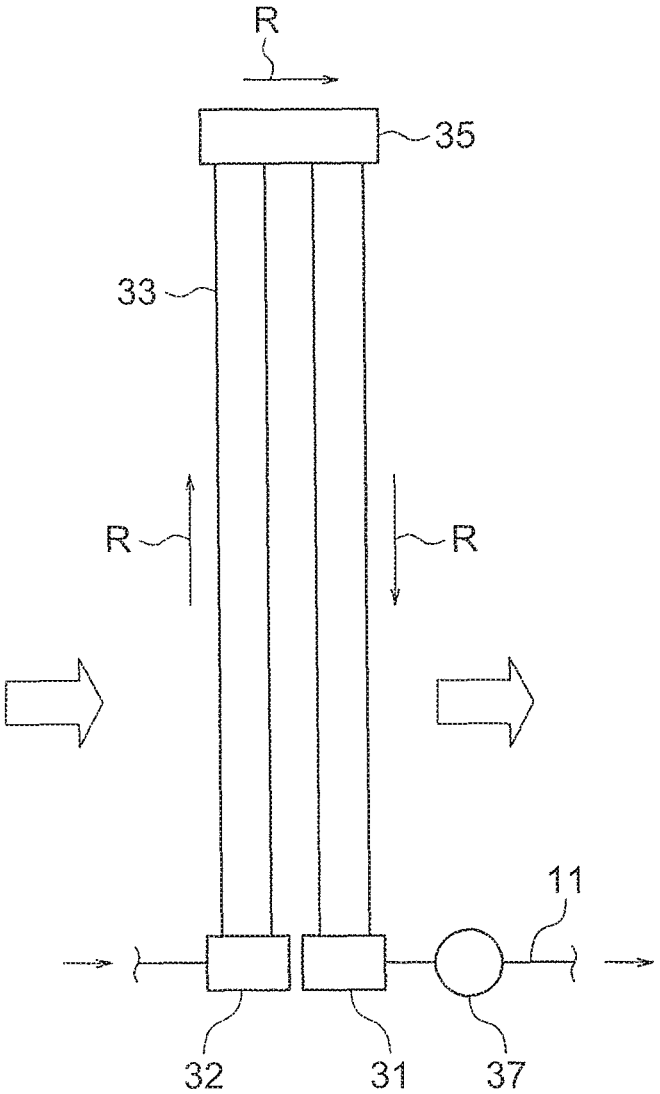
FIG. 7 is a view pertaining to the second embodiment, and showing configurations of a first row and a second row of a two-row heat exchanger.
Figure 8:
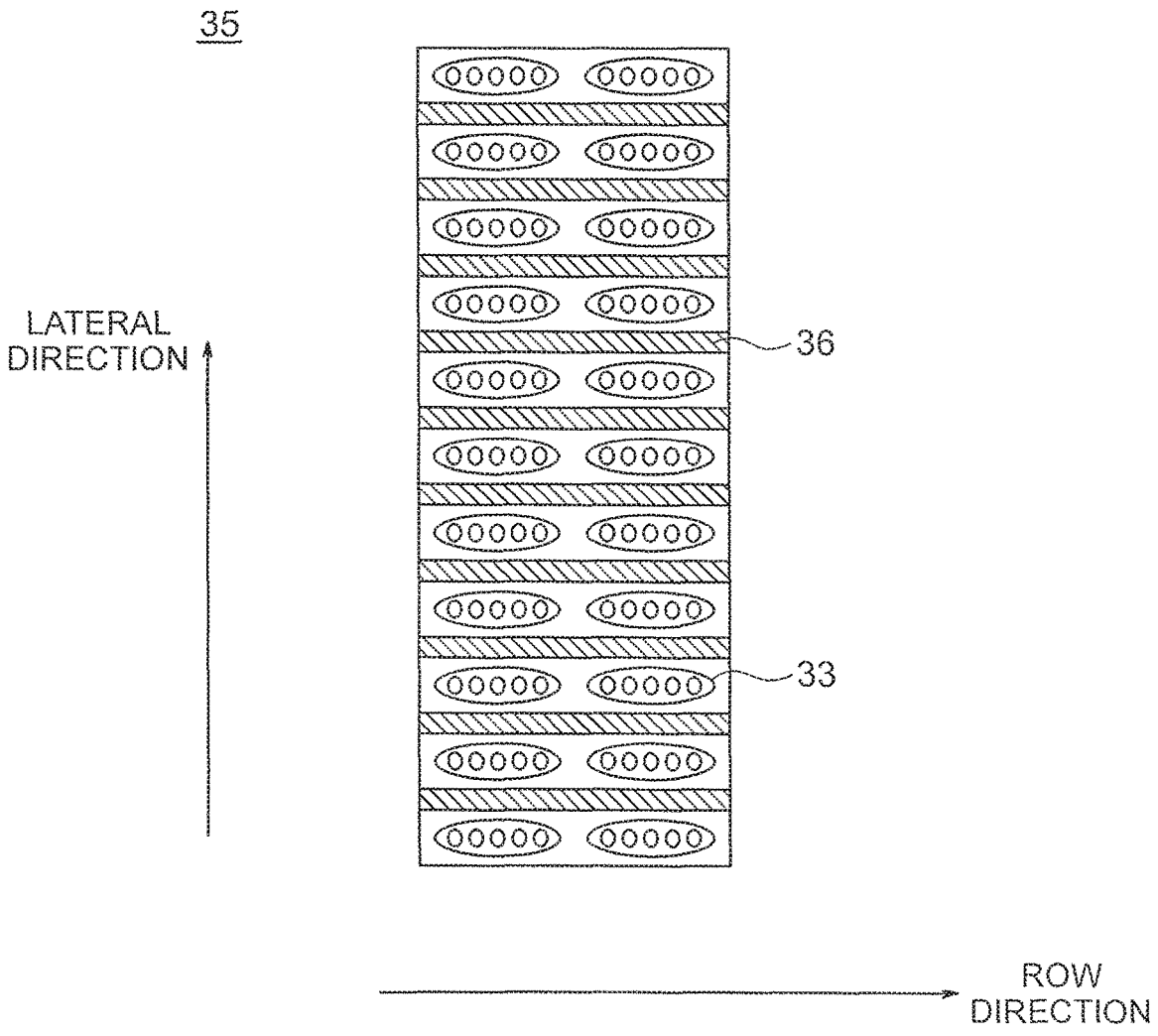
FIG. 8 is a view pertaining to the second embodiment, and showing an internal configuration of an upper section header of the two-row heat exchanger.

Next, a second embodiment of this invention will be described on the basis of FIG. 6 to FIG. 8. FIG. 6 is a view showing a connection configuration between a flow divider and a heat exchanger of an outdoor unit of a multi air conditioner for a building according to the second embodiment. FIG. 7 is a view pertaining to the second embodiment, and showing configurations of a first row (a front row) and a second row (a back row) of a two-row heat exchanger. FIG. 8 is a view pertaining to the second embodiment, and showing an internal configuration of an upper section header of the two-row heat exchanger. Note that except for parts and limitations described below, the second embodiment is assumed to be identical to the first embodiment.

In a top-flow type outdoor unit according to the second embodiment, the heat exchange sections 3*a*, 3*b*, 3*c* are allocated respectively to three intake side faces of a casing. In each of the heat exchange sections 3*a*, 3*b*, 3*c*, the plurality of heat exchange pipes 33 are divided into two groups in a lateral direction (a horizontal direction that is orthogonal to an intake direction of the corresponding heat exchange section), and the respective groups are further divided into two rows in a front-back direction (the intake direction of the corresponding heat exchange section). As shown by the reference numerals in FIG. 6, the heat exchange section 3*a* is divided into two groups 3*h*, 3*i*, and the respective groups 3*h*, 3*i* are further divided into two rows in the front-back direction. Similarly, the heat exchange section 3*b* is divided into two groups 3*f*, 3*g* and the respective groups 3*f*, 3*g* are further divided into two rows in the front-back direction, while the heat exchange section 3*c* is divided into two groups 3*e*, 3*d* and the respective groups 3*e*, 3*d* are further divided into two rows in the front-back direction. In the entire top-flow type outdoor unit, the plurality of heat exchange pipes 33 are divided into twelve rows in terms of the row units described above.

A configuration of the plurality of heat exchange pipes 33 forming one group will now be described. Arrows outlined in black in FIG. 7 show a flow of intake air, or in other words an intake direction. When the outdoor heat exchanger 3 functions as an evaporator, the gas-liquid two phase refrigerant flowing in through the liquid-side header pipe 32 rises through the heat exchange pipes 33 (the first row) of each group while exchanging heat with the air in the heat exchange pipes 33, then moves to the second row, which serves as a leeward side, through an inter-row connection section 35 provided thereabove, then falls through the heat exchange pipes 33 (the second row) while exchanging heat with the air again, and then enters the gas-side header pipe 31 disposed therebelow. In other words, arrows R in FIG. 7 show movement of the refrigerant, in which the refrigerant that rises through the heat exchange pipes 33 of the first row and the refrigerant that falls through the heat exchange pipes 33 of the second row form opposing flows. An upper end of the plurality of heat exchange pipes 33 forming the first row (a front row) and an upper end of the plurality of heat exchange pipes forming the second row (a back row) are connected by the inter-row connection section 35. In the inter-row connection section 35, the refrigerant is joined in a row direction but partitioned by partition walls 36 in the lateral direction (the arrangement direction of the heat exchange pipes 33 forming each group, or in other words a horizontal direction that is orthogonal to the intake direction of the corresponding group) so that refrigerant in adjacent heat exchange pipes in the lateral direction does not intermix.

The refrigerant flowing into the gas-side header pipe 31 flows into a liquid-side convergence pipe 37, and in the liquid-side convergence pipe 37 converges with refrigerant flowing into the liquid-side convergence pipe 37 from the gas-side header pipe 31 of an adjacent group in the lateral direction.

The refrigerant is supplied to the respective heat exchange sections via the branch section 40, a T branch section 43, and the flow control section 14. Having undergone heat exchange in the respective heat exchange sections, the refrigerant from adjacent groups converges in the liquid-side convergence pipe 37 and flows out of the outdoor heat exchanger 3 through the gas-side connecting pipe 11 and an upper section convergence pipe 12.

Next, an action of the heat exchanger according to the second embodiment, having the above configuration, will be described. During a heating operation, the outdoor unit heat exchanger 3 operates as an evaporator, and each of the three flows of refrigerant divided by the branch section 40 is divided into a further two flows by the T branch section 43 so as to form six flows. The flow rate of each flow of refrigerant in the corresponding flow passage is then controlled by the flow control section 14, whereupon the refrigerant flows into the liquid-side header pipe 32 of the corresponding heat exchange section. The reason for controlling the flow rate of the refrigerant flowing to each heat exchange section in this manner is to regulate differences in thermal load distribution, or in other words temperature distribution and air velocity distribution, among the respective heat exchange sections by means of the flow rate of the refrigerant so that the refrigerant is discharged from the respective heat exchange sections in a uniform condition. Note, however, that when the thermal load distribution in the horizontal direction is large such that a thermal load distribution exists even within the respective heat exchange sections, the refrigerant is distributed unevenly through the respective heat exchange sections. Hence, in the second embodiment, this phenomenon is dealt with by providing the six groups. The number of groups into which the heat exchange pipes are divided does not have to be limited to six, and may be set at seven or more.

Next, similarly to the first embodiment, the refrigerant flowing in from one end of the liquid-side header pipe 32 is ejected through the distribution holes 42 in the perforated pipe 41 so as to be distributed evenly to the respective heat exchange pipes 33. When the degree of dryness in the perforated pipe 41 is large, minute liquid droplets are ejected through the small holes, and when the degree of dryness is small, air bubbles shoot up into the liquid that has accumulated in the annular section. As a result, an even distribution is realized regardless of the degree of dryness and the flow rate.

The refrigerant exchanges heat with air, not shown in the drawings, while passing through the heat exchange pipes 33, then flows into the gas-side header pipe 31, flows out of the other end on the opposite side to the liquid-side header pipe 32, and converges with the refrigerant from the adjacent group in the liquid-side convergence pipe 37. In the inter-row connection section 35 thereabove, partitions are provided in the lateral direction so that heat is not exchanged directly with an adjacent heat transfer tube in the lateral direction. The refrigerant flows out through the liquid-side convergence pipe 37, passes through the corresponding gas-side connecting pipe 11, and converges in the gas-side collecting pipe 12.

The content of this invention was described specifically above with reference to preferred embodiments, but a person skilled in the art may of course implement various amendments on the basis of the basic technical concept and teaching of this invention.

For example, in the perforated pipe described above, the large number of distribution holes are oriented downward, but the manner in which the distribution holes are formed is not limited thereto, and the orientation, number, and hole shape of the distribution holes may be amended as appropriate. Further, the configuration of the branch section described above is merely an example, and may be amended as appropriate. For example, a branch section such as a Y-shaped branch pipe or a low pressure loss distributor, in which the height positions of a plurality of outlet side branch passages are varied, whereby the proportion of the divided flow of the liquid phase is varied using the effects of gravity so that the degree of dryness and the flow rate can be controlled simultaneously, may be used instead.

REFERENCE SIGNS LIST

1 Compressor
3 Outdoor heat exchanger
3*a*, 3*b*, 3*c* Heat exchange section
6 Indoor heat exchanger
11 Gas-side connecting pipe
12 Gas-side collecting pipe
13 Liquid-side connecting pipe
14 Flow control section
15 Liquid-side collecting pipe
20 First decompression valve
21 Second decompression valve
22 Third decompression valve
23 On-off valve
31 Gas-side header pipe
32 Liquid-side header pipe
33 Heat exchange pipe
34 Liquid-side convergence pipe
35 Inter-row connection section
36 Partition wall
40 Branch section
41 Perforated pipe
42 Distribution hole
43 T branch section
51 Top-flow type outdoor unit

The invention claimed is:

1. An air conditioner, comprising:

a refrigeration circuit, wherein the refrigeration circuit includes a compressor that discharges a refrigerant, an outdoor heat exchanger, a decompression valve, and an indoor heat exchanger; and a top-flow type outdoor unit, wherein the outdoor heat exchanger is provided in the top-flow type outdoor unit, and wherein the outdoor heat exchanger comprises:

a first heat exchange section having a first liquid-side header pipe, a first gas-side header pipe, and first heat exchange pipes;

a second heat exchange section having a second liquid-side header pipe, a second gas-side header pipe, and second heat exchange pipes, wherein the first heat exchange section and the second heat exchange section are connected in parallel to one another;

a branch section that distributes the refrigerant to the first liquid-side header pipe and the second liquid-side header pipe, and a flow control section that controls a flow rate of the refrigerant being connected between the first liquid-side header pipe and the branch section, wherein:

the first heat exchange pipes include an upstream group of heat exchange pipes and a downstream group of heat exchange pipes;

the first heat exchange section includes an inter-row connection section that connects the upstream group of heat exchange pipes to the downstream group of heat exchange pipes in parallel, the downstream group of heat exchange pipes is separate from and downstream of the upstream group of heat exchange pipes, the inter-row connection section includes a plurality of connection portions, which are partitioned from one another by partition walls, each of the connection portions connects a heat exchange pipe of the upstream group of heat exchange pipes to a corresponding heat exchange pipe of the downstream group of heat exchange pipes, refrigerant flows into the first liquid-side header pipe and flows successively through the upstream group of heat exchange pipes, the plurality of connection portions of the inter-row connection section, the downstream group of heat exchange pipes, and the first gas-side header pipe, and the refrigerant flowing through the upstream group of heat exchange pipes flows in an opposite direction to the refrigerant flowing through the downstream group of heat exchange pipes.

2. The air conditioner according to claim 1, wherein the refrigeration circuit includes a gas-liquid separator, and a liquid or a two-phase refrigerant separated by the gas-liquid separator is supplied to the liquid-side collecting pipe.

3. The air conditioner according to claim 2, wherein refrigerant gas subjected to the gas-liquid separation is heated by high-pressure liquid refrigerant and returned to an intake section of the compressor.

4. The air conditioner according to claim 1, wherein a refrigerant exhibiting depressurization is used.

5. The air conditioner according to claim 1, wherein HFO1234yf, HFO1234ze, or R134a, all of which are low pressure refrigerants, is used as the refrigerant.

6. The air conditioner according to claim 1, wherein the heat exchange pipes of the upstream group of heat exchange pipes are parallel to and spaced apart from the heat exchange pipes of the downstream group of heat exchange pipes.

7. The air conditioner according to claim 1, wherein the first heat exchange pipes are orthogonal to a direction of air flow into the first heat exchange section.

* * * * *